United States Patent [19]

Polk

[11] Patent Number: 4,620,669

[45] Date of Patent: Nov. 4, 1986

[54] BLOW-BY CIRCUIT

[75] Inventor: Gary C. Polk, Eden Prairie, Minn.

[73] Assignee: Wagner Spray Tech Corporation, Minneapolis, Minn.

[21] Appl. No.: 768,213

[22] Filed: Aug. 22, 1985

[51] Int. Cl.[4] ..... B05B 9/04

[52] U.S. Cl. ..... 239/120; 239/332; 222/108; 222/318

[58] Field of Search ..... 239/120, 332, 333–334, 239/340, 346, 337; 222/108–110, 318; 92/86, 86.5; 417/439

[56] References Cited

U.S. PATENT DOCUMENTS

| | | | |
|---|---|---|---|
| 1,013,348 | 1/1912 | Whitaker | 417/439 |
| 2,279,010 | 4/1942 | Nichols | 234/120 |
| 3,554,408 | 1/1971 | Fremstad | 222/109 |
| 3,809,506 | 5/1974 | Malcosky | 417/439 |

*Primary Examiner*—Joseph F. Peters, Jr.
*Assistant Examiner*—Kevin Patrick Weldon
*Attorney, Agent, or Firm*—Hill, Van Santen, Steadman & Simpson

[57] ABSTRACT

There is disclosed herein a liquid spray gun which may be used for spraying paint. The gun includes a piston pump for withdrawing liquid from a reservoir and providing a force for spraying the liquid. The gun also includes a nozzle for receiving liquid from the piston and spraying the liquid under pressure. The piston pump includes a collection port for accumulating leakage liquid or flow from within the pump. A fluid circuit collects leakage liquid from the collection port and delivers the leakage liquid to a position forward and adjacent the nozzle. The fluid circuit includes a conduit having an inlet end connected to the collection port and an outlet end positioned adjacent the nozzle. The high velocity spray creates a low pressure area adjacent the nozzle and a venturi effect in the fluid circuit means for cooperation in drawing the liquid from the collection port to the nozzle.

6 Claims, 4 Drawing Figures

BLOW-BY CIRCUIT

BACKGROUND OF THE INVENTION

This invention relates to liquid spray guns which utilize a reciprocation-type piston pump, and more specifically, to a system for usefully disposing of leakage flow from said pump.

Liquid spray guns which are used to spray liquids such as paint are known in the art. Some of the pumps include an electromagnetic motor which includes an armature that oscillates with the AC cycle. The oscillating armature drives a piston pump, and more specifically a piston rod, which reciprocates and draws the liquid to be sprayed from a reservoir, such as a paint can, and delivers the liquid to a spray nozzle. Such guns are shown in U.S. Pat. Nos. 3,445,068; 3,899,134; and 4,160,525.

In such guns liquid or paint leaks past the piston rod during use. The leakage liquid is collected and exits the pump through a collection or blow-by port. The exiting liquid is then collected for disposal or reuse. If the gun uses a suction tube for drawing liquid from a reservoir, such as a paint can, a long tube is provided to return the leakage liquid to the reservoir. If a liquid supply cup is being used, then the leakage liquid or paint is returned to the supply cup, but this requires regular emptying of the cup.

It is an object of this invention to more efficiently recycle the leakage liquid.

It is another object of this invention to eliminate the long return tube and the emptying of the supply cup.

These and other objects of this invention will become apparent from the following description and appended claims.

SUMMARY OF THE INVENTION

This invention utilizes a fluid circuit and the venturi effect for recycling leakage liquid from the collection port to the spray nozzle. By using this circuit and effect, the long return tube and the periodic emptying of the supply cup is eliminated.

In the gun of this invention a fluid circuit or conduit is connected at one end to the leakage collection port, which is sometimes referred to as a blow-by port, and the other or delivery end is positioned adjacent the spray nozzle. The delivery end is provided with a small diameter tip that is positioned adjacent the spray nozzle.

The venturi effect is created by the liquid flowing at a high velocity through the nozzle and over the small diameter orifice or tip. The liquid flowing through the nozzle at a high velocity forms a low pressure area at or near the tip. By directing the leakage liquid, usually paint, to the nozzle via the liquid circuit, the low pressure area adjacent the nozzle and high velocity liquid exiting the nozzle draws leakage liquid from the small diameter tip, shears the same and introduces the leakage liquid into the main spray pattern.

This action allows continuous spraying without the need for emptying a cup or for a return tube.

DESCRIPTION OF THE PREFERRED EMBODIMENT

Figure 1:
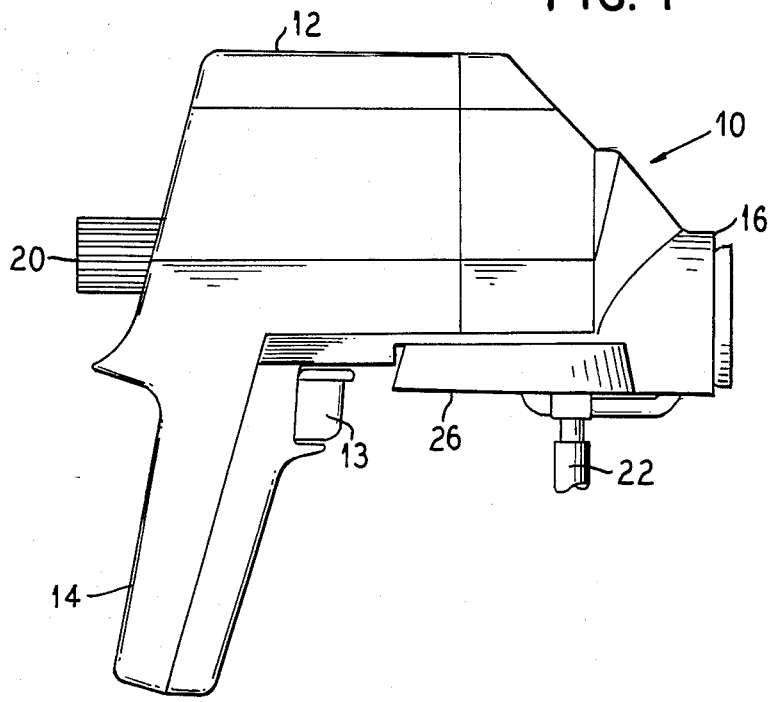
FIG. 1 is a side elevational view of the spray gun.

Referring now to the drawings, there is shown in FIG. 1 a liquid spray gun 10 which includes a gun-shaped housing 12 that forms a depending handle 14 at the back end of the gun and a spraying end 16 at the front end of the gun. The gun also includes an activator switch or trigger 18 in the handle and a spray adjuster knob 20 in the back end of the housing.

Figure 2:
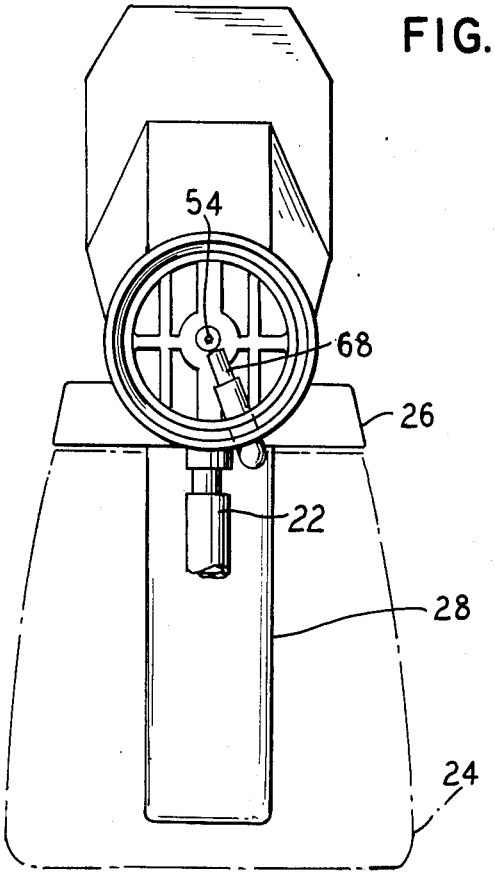
FIG. 2 is a front elevational view of the gun with a supply cup or liquid reservoir shown in dashed lines.

A liquid supply tube 22 is shown depending from the front end of the gun. A liquid reservoir or cup 24 is shown in FIG. 2 mounted to the bottom of the housing adjacent the front end thereof by way of the collar 26. The supply tube 22 is shown extending into the supply cup 24 which includes a filter system 28.

Figure 3:
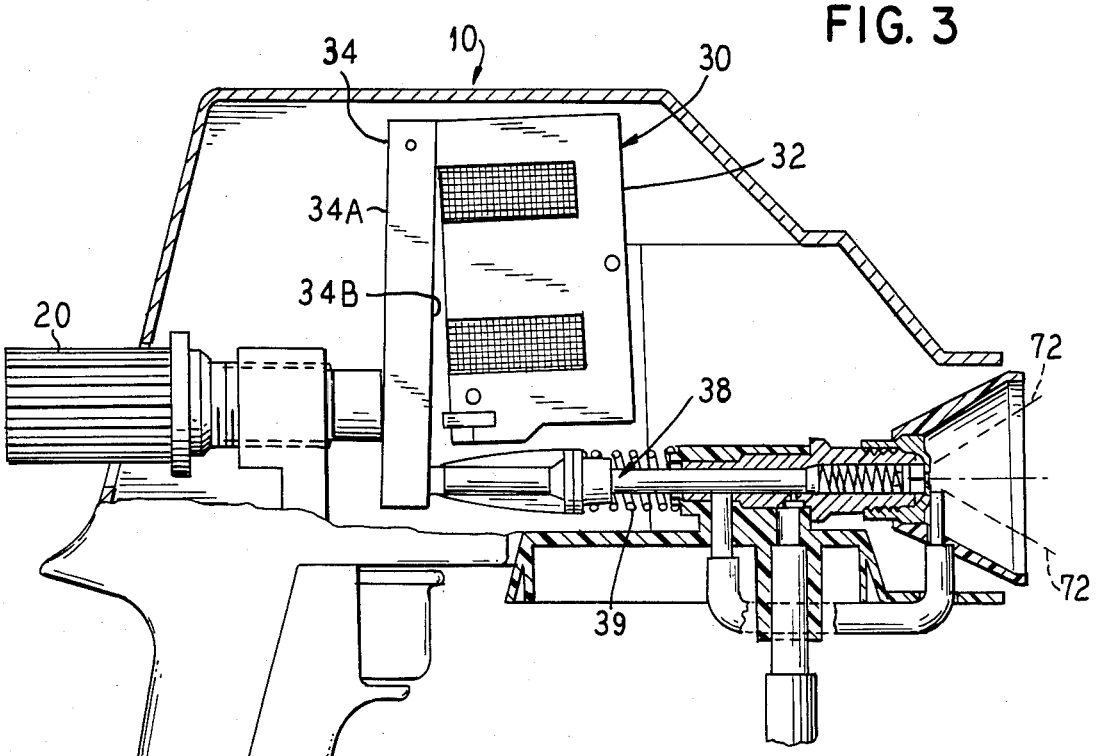
FIG. 3 is a longitudinal cross-sectional view showing the interior of the gun.
Figure 4:
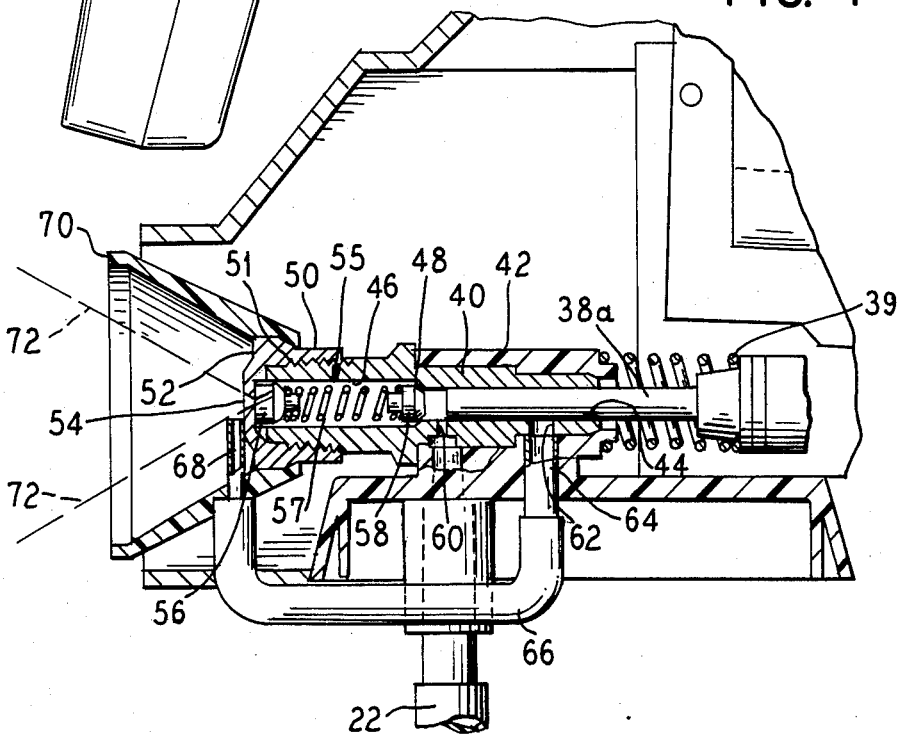
FIG. 4 is an enlarged sectional view of the piston pump and fluid circuit of this invention.

Referring now to FIGS. 3 and 4, the operating mechanism for the gun 10 includes an electromagnetic motor 30 which includes a stator and electromagnet coils 32 and a pivotable armature 34 that oscillates in response to the AC cycle. The throw or movement of the armature is controlled by the adjuster 20, which limits the rearward movement of the armature by engaging its rearward face **34*a*. The armature 34 drives the piston pump 36**, generally.

The piston pump 36 includes a piston rod assembly 38, the back end of which is biased against and engages the front face **34*b* of armature 34. The biasing spring 39 engages the piston rod assembly and biases the rod assembly rearwardly and against the armature 34. The forward end of the piston rod assembly 38 includes a piston rod 38*a*, which sealingly and slidingly engages a cylinder sleeve 40 which fits within a cylinder mounting 42** that is integral with the gun housing.

The cylinder sleeve 40 includes a piston rod-receiving bore 44 and a larger diameter flow-receiving bore 46 upstream of the piston rod bore. A check valve seat 48 is formed in the cylinder sleeve at the junction of the piston rod bore 44 and the flow section 46.

The exterior of the sleeve adjacent the downstream end is threaded for receiving an internally threaded nozzle cap 50. The cap includes a cylindrical wall 51 for engaging the cylinder and a transverse wall 52 for closing the downstream end of the cylinder sleeve. A spray orifice or nozzle 54 is formed at the center of the wall 52. A flow controlling check valve 55 is positioned in bore 46 between the seat 48 and transverse wall 52. The check valve includes an internally bored spring keeper 56 that is positioned against the transverse wall 52, a biasing spring 57, and a valve element 58 that is biased against and seats on the valve seat 48.

A liquid inlet 60 is formed in the cylinder sleeve 40 at the downstream end of the piston rod bore. The inlet 60 is connected to the liquid supply tube 22 and cooperates in delivering liquid to the pump. A pumping chamber for receiving liquid from the supply tube is formed by the sleeve 40, the valve element 58, and the downstream end of the piston rod **38*a*. On the rearward or retraction stroke of the rod 38*a*, under the action of the biasing spring, liquid is drawn into the chamber so as to fill the chamber. On forward stroke of the rod, under the action of the armature, the valve element 58 is unseated and liquid is expressed from the chamber around the valve element, through the flow bore, and out the nozzle 54**.

Under the pumping pressure, some liquid will flow, in the rearward direction, and between the piston rod 38a and cylinder sleeve 40. This liquid is referred to as leakage liquid or leakage flow. A collection or blow-by port 62 is formed in the sleeve, upstream of the inlet port 60, for disposing of the leakage flow. The collection port 62 is connected to the inlet end 64 of a fluid circuit or tubing 66. The tubing is U-shaped and has a small diameter outlet orifice 68 at its outlet end. The outlet orifice is positioned adjacent and immediately forward of the spray nozzle 54.

A spray guard 70 is secured to the nozzle cap 50 and extends forwardly of the nozzle 54. As seen in FIG. 2, the spray guard is circularly shaped, has an open mesh-like structure formed by interconnecting ribs, and the guard fits within a circular opening in the gun housing.

In operation, the piston pump is activated by squeezing switch 18 that in turn energizes the electromagentic motor causing the piston rod to reciprocate. The pumped liquid is expressed from the nozzle at a high velocity, which forms a lower pressure area adjacent and forward of the nozzle as suggested by dashed lines 72. The low pressure area and high velocity spray, which has been referred to as the venturi effect, cooperate in drawing leakage flow from the blow-by port 62, to the orifice outlet 68 for direct recycling into the spray. This system eliminates the need to collect the leakage flow in a cup or a return line to return the flow to a reservoir. An additional advantage to this system is that additional liquid is added to or recycled into the spray.

Moreover, the low pressure area forward of the spary guard draws heated air out from within the gun through the ribbed spary guard. This enhances the efficiency of the gun by aiding in cooling the electromagnetic motor 30.

Although the invention has been described with respect to preferred embodiments, it is not to be so limited as changes and modifications can be made which are within the full intended scope of the invention as defined by the appended claims.

I claim as my invention:

1. A liquid spray gun which includes:

piston pump means for withdrawing a liquid from a reservoir and providing a force for spraying the liquid;

nozzle means for receiving liquid from the piston pump and spraying said liquid at a high velocity, said piston pump means including collection port means for accumulating leakage flow from within said pump; and fluid-circuit means for collecting leakage flow from said collection port means and delivering said leakage flow to a position forward and adjacent the nozzle, said circuit means including conduit means having an inlet end connected to said collection port and an outlet end positioned adjacent said nozzle, whereby said spray induces a venturi effect in said fluid circuit means for cooperation in drawing leakage flow from the collection port to the nozzle.

2. A spray gun as in claim 1, wherein said outlet end includes a tip having a smaller cross-sectional area than said fluid conduit means.

3. A spray gun as in claim 2, wherein said conduit is a tube.

4. A spray gun as in claim 3, wherein said gun includes a spray guard surrounding said nozzle, said nozzle having a plurality of ribs which form an open mesh-like construction, said outlet end extending through said guard to said position adjacent said nozzle.

5. A spray gun as in claim 1, wherein there is further provided a spray guard having a plurality of interconnecting ribs for forming an open mesh-like structure, said guard surrounding said nozzle and providing communication with an interior of the gun through the open mesh-like structure of said spray guard, whereby the low pressure area draws heated air from the gun interior through the spray guard.

6. A paint spray gun which includes:

a gun-shaped housing having a depending handle at the rearward end and a paint spray nozzle at the forward end;

an oscillating-type electromagnetic motor having a pivotable armature that oscillates in response to an AC cycle;

a piston-type pump having a reciprocable piston rod in driving cooperation with said motor armature;

cylinder sleeve means mounted in said housing and having a bore constructed to receive said piston rod in sliding and sealing engagement, said sleeve having an inlet port opening into said bore and a leakage liquid collection port opening into said bore upstream of said inlet port;

fluid conduit means communicating with said bore and said nozzle, whereby paint is delivered from said piston rod receiving bore to said nozzle to be expressed therefrom;

fluid circuit means communicating with said collection port and a position forward of and adjacent said nozzle;

whereby paint exiting said nozzle creates a low pressure area adjacent said nozzle and said low pressure area cooperates in drawing paint from said collection port through said fluid circuit means and into said spray.

* * * * *